US005234379A

United States Patent [19]

Zotos

[11] Patent Number: 5,234,379

[45] Date of Patent: Aug. 10, 1993

[54] CUE BALL ACCURATE REBOUND TOOL

[76] Inventor: Michael R. Zotos, 45 First Ave., Holtsville, N.Y. 11742

[21] Appl. No.: 946,091

[22] Filed: Sep. 17, 1992

Related U.S. Application Data

[63] Continuation-in-part of Ser. No. 812,746, Dec. 24, 1991, Pat. No. 5,154,415.

[51] Int. Cl.[5] ..... A63D 15/00

[52] U.S. Cl. ..... 273/2

[58] Field of Search ..... 273/2, 14

[56] References Cited

U.S. PATENT DOCUMENTS

| | | | |
|---|---|---|---|
| 2,537,228 | 1/1951 | Matson | 273/14 |
| 3,220,122 | 11/1965 | Miller | 273/14 |
| 3,299,537 | 1/1967 | Franks | 273/14 |
| 3,463,593 | 8/1969 | Hoarn | 273/14 |
| 4,178,694 | 12/1979 | Bonney | 273/14 |

*Primary Examiner*—Theatrice Brown

[57] ABSTRACT

The device is comprised of a shaped member having a straight edge attachable to the rails of a pool table so the the straight edge of the shaped member is directly over the inside edge of the rebound cushion, and can be slid along the rail of the table from side to side. There are two weighted posts with draw twines attached at their top One of the posts is situated on the table at the exact point that the ball is presently at, while the other post is situated on the table at the exact spot where the ball is to end up after it rebounds off the cushion. Each of the twines is drawn to the center point of the straight edge of the shaped member; this created a straight line from each post to a center point of the straight edge of the shaped member. The existence of both these straight lines create an angle from one post to the center point of the straight edge of the shaped member to the other post that can be identified on the face of the shaped member. As the straight edge is moved from side to side on the rail the angle changes. Guide marks on the shaped member gives a measurement of each line from the forward center of the shaped member referred to as the ninety degree point. The shaped member can be moved along the tail until both lines are at an equal distance from the ninety degree point. A hole is placed in the shaped member at the ninety degree point whereby a marker member can be inserted to mark the spot of rebound of a ball from the rail cushion.

9 Claims, 4 Drawing Sheets

CUE BALL ACCURATE REBOUND TOOL

BACKGROUND OF THE INVENTION

This is a continuation in part of application Ser. No. 07/812,746, filed on Dec. 24, 1991 (U.S. Pat. No. 5,154,415)

The present invention is a device to be used in the game known as "POOL" or "BILLIARDS". It is used to indicate the point on the cushion of a pool table that a ball needs to strike in order to rebound into a specific pocket, or in order to rebound into a specific ball to drive that ball into a specific pocket. The tool is designed to be a learning aid for those people interested in developing their skill at rebound shots in the game of pool or billiards.

The game of pool is a game of skill which is developed over time with practice. One learns to be able to hit a ball into another ball with a cue stick, and send it into a pocket. Many of the shots require the player to successfully rebound the ball off a cushion and into the ball that is to enter the pocket, or to hit the ball, commonly referred to as the cue ball, into the ball that is to enter the pocket at such an angle as to cause it to rebound off a cushion and into the pocket. These shots, known as "bank shots", are most difficult to master. The reason being that no two shots are exactly the same. Each time a person attempts a bank shot and fails, the shot has disappeared and cannot easily be analysed. Compounded with this problem is the fact that a bank shot is an angle shot. Once a ball leaves the cushion that it has been caused to strike, and moves in a direction at a degree that was not intended, the distance that it travels before contacting another ball or cushion largely determines how far "off" the bank shot might be. This creates a distorted view of the inaccuracy of the unsuccessful bank shot, and relieves the player of the ability to learn from his mistakes. It is therefore beneficial for the player to have the ability to see in advance of attempting a bank shot, where on the cushion the ball must rebound in order for the shot to be made. And for that purpose I have invented the Cue Ball Accurate Rebound Tool.

FIELD OF THE INVENTION

It is a well known fact that a cue ball will leave a cushion at the same angle at which it strikes the cushion. The distance to or from that cushion is not relevant. Only where that ball is, where it must end up, and then where on the Cushion that same angle is located.

DESCRIPTION OF THE RELATED ART

Numerous prior art devices have been devised to aid a player in improving his skill in shooting pool. The following references display forms of devices whereby a ball rebound point is determined for banking a ball off of the table cushion and thus into a designated pocket. Reference, U.S. Pat. No. 2,537,228, (MATSON) displays a ball rebound angle, indicator having a pair of rigid arms pivotally attached to a member for connecting the apparatus to a rail of a pool table. The reference, U.S. Pat. No. 3,463,593 (HORAN) shows a protractor shaped device made in the form of a curved mirror and having a plurality of equally spaced graduation for aligning a ball with a ball rebound spot located on a cushion with a designated pocket. Although these references do tend to address the solution to a problem in which I am proposing, the manner of aligning a ball for rebounding from a predetermined spot on a table cushion and into a designated pocket as the references disclose is in no way s®en to be compatible to the new apparatus which I have invented and disclosed herein.

SUMMARY

The Cue Ball Accurate Rebound Tool is a lightweight device that is easily set up on the pool table, operated, and removed, before the shot is attempted. Leaving only a chalk mark on the cushion at the precise spot on the cushion that the ball must strike in order for the shot to be made.

DESCRIPTION OF THE PREFERRED EMBODIMENT(S)

Figure 7:
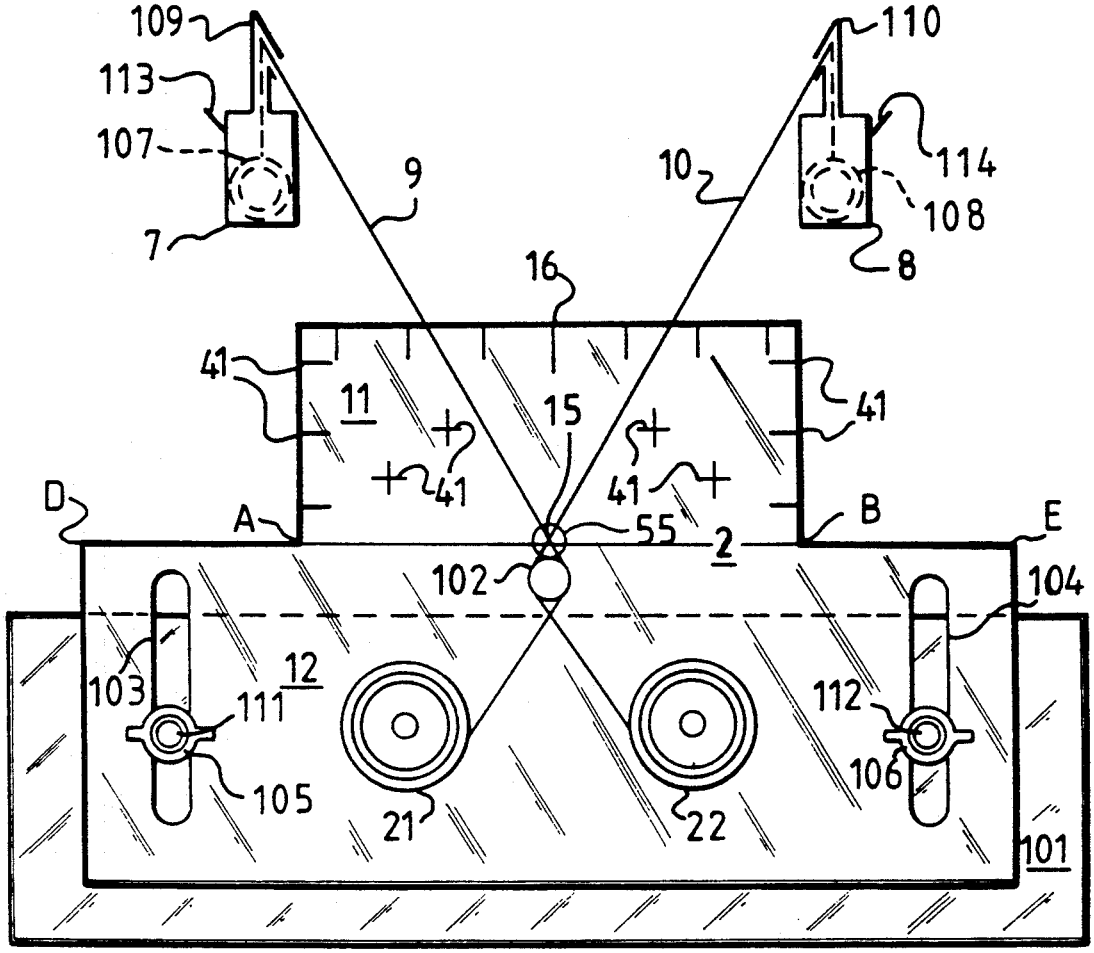
FIG. 7 is an overhead view of the Cue Ball Accurate Rebound Tool showing additional features and new possibility for manufacture of the device.
Figure 8:
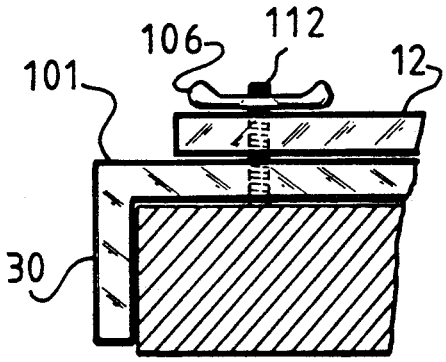
FIG. 8 is a side view of the wing nut and screw, holding the board element and the secondary board element together.

The Cue Ball Accurate Rebound Tool #2 consists mainly of a shaped element #11, attached to a board element #12. These parts should be made of a strong clear plastic, and it is preferred that they are casted as a single part. It is most important that the shaped element #11, FIG. 7, be a surface that will extend over the cushion of the pool table #5, FIG. 1, when the board element #12 is placed on the top of the rail of the pool table #4. There is a front edge; Line D-E FIG. 7, that is intended to align with the inside edge #33, FIG. 1, of the pool table in a position so that the points (A) and (B) will both be flush over the edge of the cushion #33. Beneath the board element #12, lies a secondary board element #101, FIG. 7. This is designed to make the device adjustable to fit pool tables with various sized rails. The secondary board element #101 has screws protruding upward from its flat surface #111 and #112, FIG. 7, to attach it to the board element #12. The screw holes on the board element #12 FIG. 7, are slits #103 and #104, so that the board element can ride along the screws #111 and #112, in a forward or backward direction, and thereby change the size of the board element. The screws are fitted with wing nuts #105 and #106 which can be hand loosened and tightened for immediate adjustment at the pool table. The secondary board element #101 has a rear retaining lip #30, FIG. 8, This is to keep the base #2 stabile on the rail #4 as the device is being operated. The rear retaining lip #30 need be as deep as necessary to keep the device from falling forward onto the pool table, and may run the entire rear edge of the secondary board element #101.

The main body of the Cue Ball Accurate Rebound Tool #2 is placed on the rail #4 of the pool table in an approximate location where the player believes the subject ball (S) must strike in order for the shot to be made. The two wing nuts #105 and #106 are loosened and the rear retaining lip #30 is placed along the rear edge of the rail #4, and the secondary board element #101 is held in place as the board element #12 is slid forward or backward until the front edge; Line D-E FIG. 7, is aligned over the inside edge #33 of the rail. The two wing nuts #105 and #106 are tightened and the points (A) and (B) are now flush over the inside edge #33.

Figure 1:
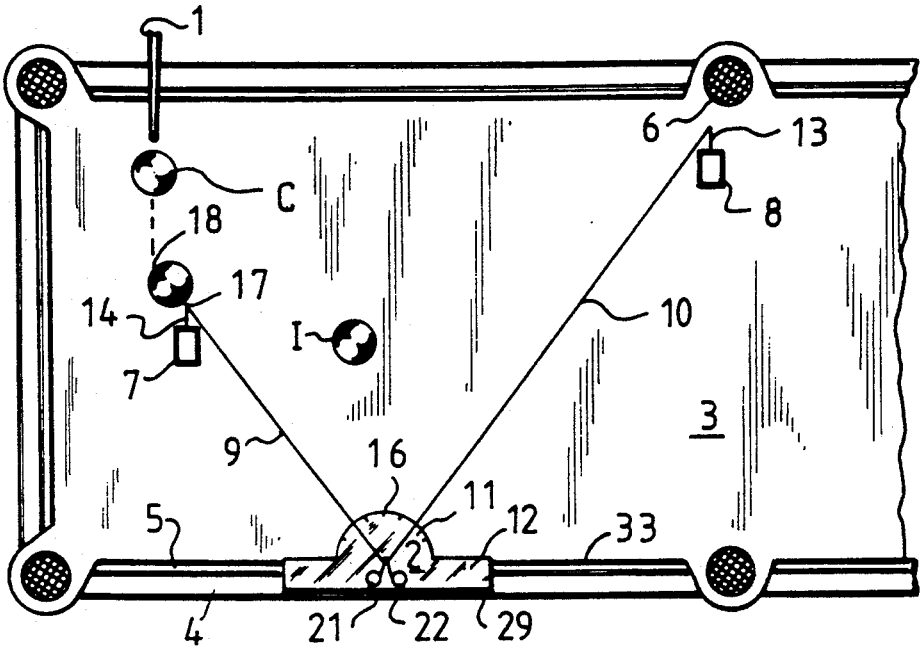
FIGS. 1 and 6 are overhead views of the Cue Ball Accurate Rebound Tool set up on a pool table. These views show the device as it would appear once the exact identical angle has been located.
Figure 2:
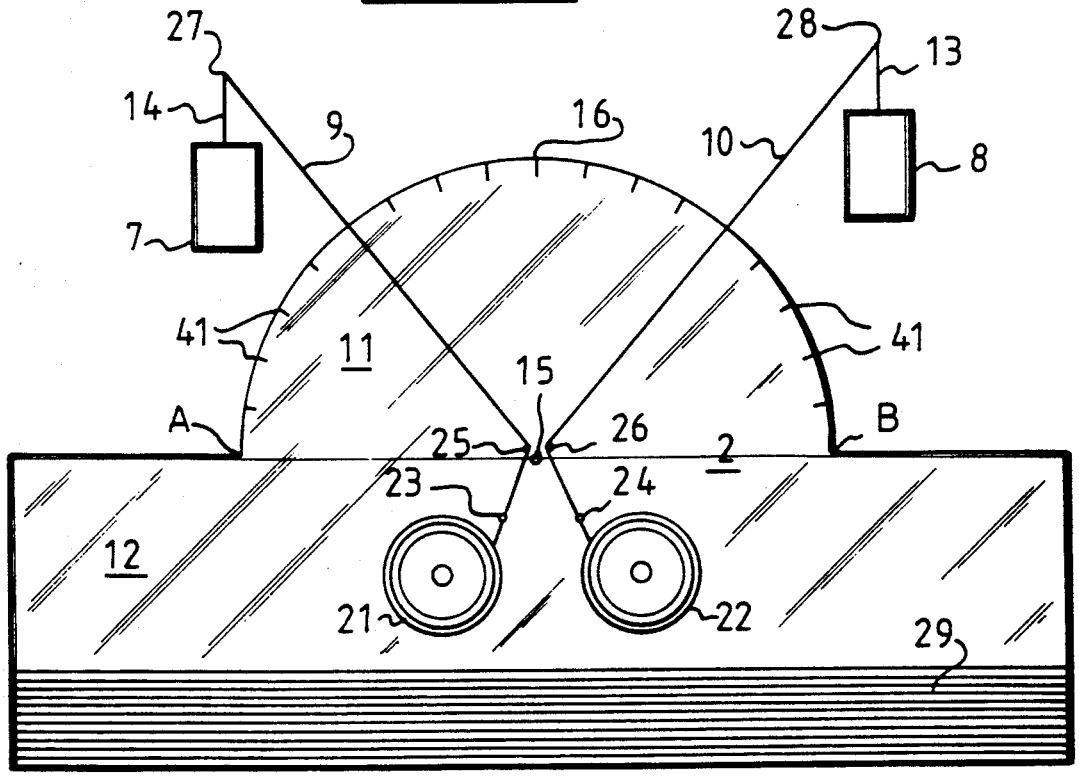
FIG. 2 shows the Cue Ball Accurate Rebound Tool in an overhead view in precisely the same state as FIGS. 1 and 6. This view shows the device in graphic detail from overhead.
Figure 3:
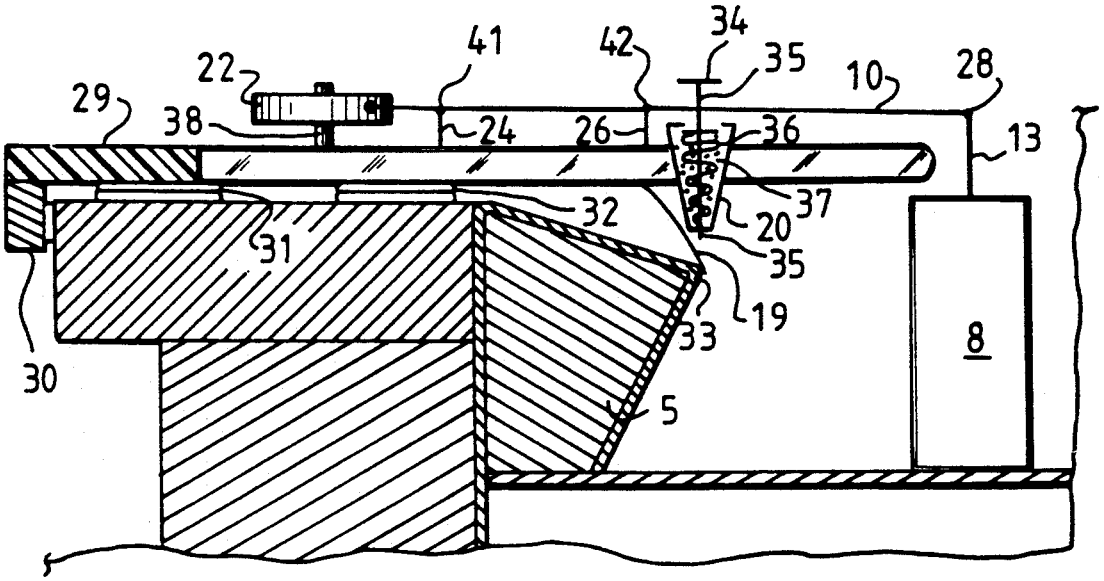
FIG. 3 shows the Cue Ball Accurate Rebound Tool from a side view as it would appear set up on a pool table.
Figure 4:
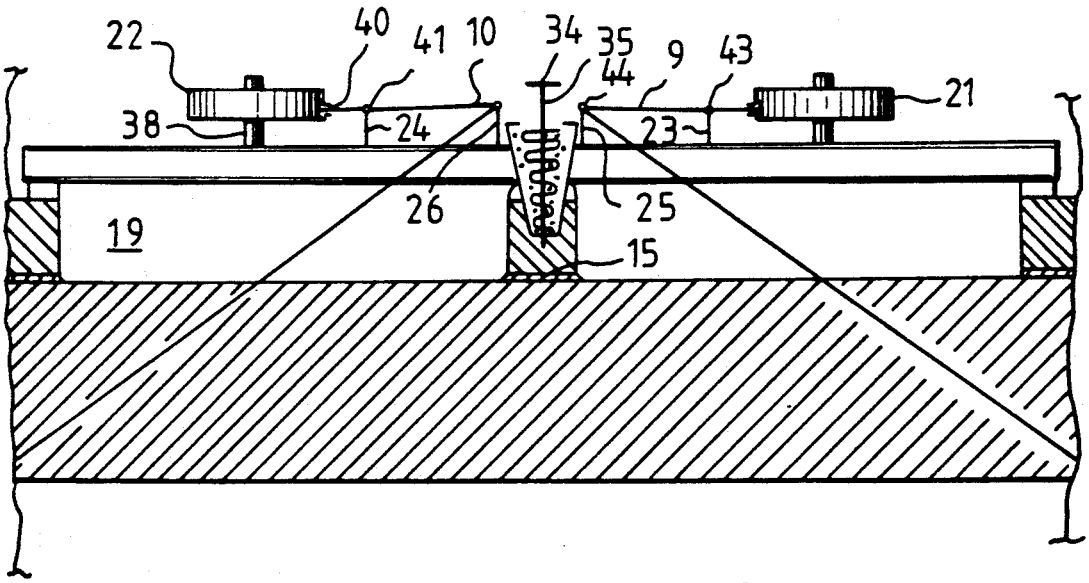
FIG. 4 shows the Cue Ball Accurate Rebound Tool from a front view as it would appear set up on a pool table.
Figure 5:
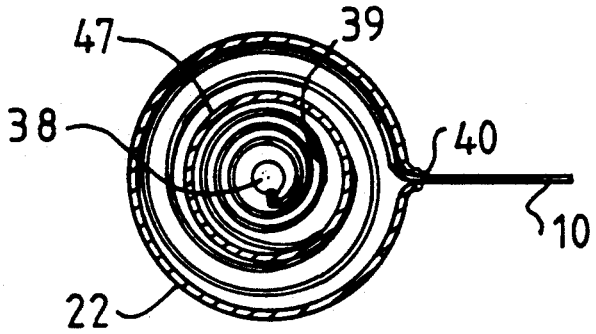
FIG. 5 shows a top view of a retracting twine spindle, one of the important parts of the device. This view is drawn to show the spindle as it would appear uncovered. It is a view of the insides of the part shown.
Figure 6:
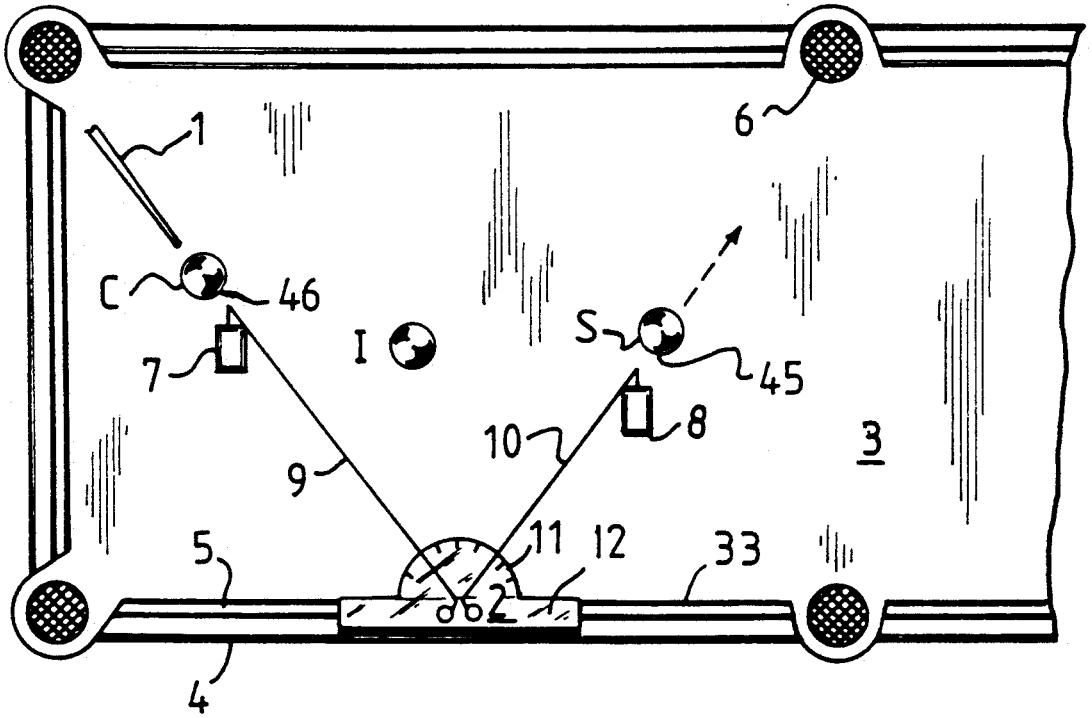

One of two weighted posts #8 is moved out, onto the pool table #3, and situated in front of the target pocket #6 FIG. 1. This post has a needle behind it #114 FIG. 7, so that a very precise location on the table can be made by eye. It is important that the post be situated so that a ball traveling from the center point #15, toward the post #8 along the line created by the two; (line 15-8), would fall into the target pocket #6 if it were to travel so far. A tube #110, FIG. 7, attached to the post #8, has a twine #10 running through it, and into a post retracting twine spindle #108. This twine #10 is attached to a base retracting twine spindle #22 situated on the base of the device #2. The twine #10 is kept in a certain position at the base by a center #guide post #102, FIG. 7, which the twin #10 rides around as the post #8 is moved. The center guide post #102 must be situated directly behind the center hole #55 so that the line created between the post #8 and the center guide post #102 passes directly over the center hole #55, FIG. 7. This will be important when the angle is located. The retracting twine spindle #22 and the post retracting twine spindle #108 keep tension on the twine #10 as the post #8 is moved out, or in, and situated. This tension serves to create a straight line from the point that the twine #10 is drawn from at the center guide post #102, and the post #8 in front of the target pocket #6. This line will remain straight even when the base #2 is moved from side to side along the rail #4.

The other of the two weighted posts #7 is moved out, onto the pool table #3, and situated at the subject ball (S). It is very important that the post #7 is placed at a certain point #17 FIG. 1, which is a point at the subject ball (S#that it must descend from if it is to travel toward the shaped element #11, and reach the center point #15. The best way to locate this point is to take aim at the subject ball (S) with a cue stick #1, from the point away from the shaped element ; #18 FIG. 1, aiming as if the player intends to strike the subject ball (S) and send it to the center point #15. The proper descend point of the ball is directly opposite that point #18, and on the other side of the ball #17. The post #7 has a needle behind it #113 to make it easy to situate it in the exact spot that the ball must descend from #17. A tube #109, attached to the post #7, has a twine #9 running through it, and into a post retracting twine spindle #107. This twine #9 is attached to base retracting twine spindle #21 situated on the base of the device #2. The twine #9 is kept in a certain position at the base by a center guide post #102, which the twine #9 rides around as the post #7 is moved. The post retracting twine spindle #107 and the base retracting twine spindle #21 keep tension on the twine #9 as the post #7 is moved out, or in and situated. This tension serves to create a straight line from the point that the twine is drawn from at the center guide post #102, and the post #7, in front of the subject ball (S), where the subject ball must descend from if it is to travel toward the shaped element #11, and reach the center point #15. This is the straight line; (line 17-15) This line will remain straight even if the base #2 is moved from side to side along the rail #4.

With the first post #8 situated at the target pocket #6, and the other post #7 situated at the subject ball (S), and the base #2 situated on the rail of the pool table #4, so that the points (A) and (B) are both flush with the edge of the cushion #33, there are now two straight lines created by the two twines #10 and #9 which meet at the center point #15, and thereby form the angle (angle 113-15-114). As the base #2 is moved from side to side along the rail #4, the angle (angle 113-15-114) can be changed. As this is being done the marks #41 along the shaped element #11 that each twine #9 and #10 meets, changes. These marks #41 along the shaped element #11 are measurement marks. These are to indicate a distance that the twine is from the ninety degree point #16. The ninety degree point #16, being a point on the shaped element #11, that is ninety degrees from either point (A) or point (B) on the line (A-B). By moving the base #2 along the rail #4,. from side to side until the twine on one side #10 is at the measurement mark #41 that is equally distant from the ninety degree point #16, as the measurement mark #41 that the other twine #9 is at, is from the ninety degree point #16 in the other direction, one can locate the spot on the cushion where the angle formed by the ninety degree point #16, the center point #15, and the first post twine point #114 (angle 16-15-114) is equal to that formed by ninety degree point #16, the center point #15, and the other post point #113, (angle 16-15-113) This is the spot along the rail #4 that the subject ball (S) must strike in order for it to rebound into the target pocket #6.

At this point the entire device is set up and the angle has been located. Now it is necessary to identify that spot #15 on the inside edge of the cushion #33. Since the center hole #55, FIG. 7, is now situated directly over the cushion edge #33, at the perfect location; (equal angle 114-15-113), the player places a stick of chalk into the hole #55, leaving a mark on the inside cushion #33. The entire device is removed from the pool table and the player may analyze and execute the shot successfully.

I claim:

1. A rebound point locator device for pool and billiard tables having rebound cushions and rails, comprising;

a measurement member, said measurement member having a shaped portion and a straight portion, said straight portion having first and second connecting points connecting respective ends of said shaped portion, said shaped portion having a 90 degree mark and a plurality of measuring marks thereon, said 90 degree mark being on an imaginary line extending perpendicular from said straight portion and from a point on said straight portion midway between said first and second points, and said measuring marks being equally spaced in opposite directions from said 90 degree mark;

means for attaching said measurement member to the rail and cushion of a pool table, whereby said measurement member will rest along the inside edge of the rebound cushion;

a pair of post means for being independently and movably positioned at predetermined locations on a pool table playing surface remote from said measurement member;

a pair of elongated connector means, said connector means extending from a respective post means to said measurement member;

attachment means attaching one end of each connector of said pair of connector means to a respective post means and its other end to said measurement member substantially at said mid-point.

2. The rebound point locator device as defined in claim 1, wherein said means for attaching said measurement member to the rail and cushion extend over a horizontal top portion and downward along an outer vertical portion of the rail.

3. The rebound point locator device as defined in claim 1, wherein, said connector means is twine, said post means has a predetermined weight, and said attachment means attaching said connector means to said post is a needle having an eye which receives said one end of said twine, and wherein said means for attaching said other end of said connector means to said measurement member is a retracting twine spindle whereby the length of said twine may be increased or decreased as said post is moved relative to said measurement member.

4. The rebound point locator device as defined in claim 1, wherein, said measurement member is provided with means at said mid-way point for placing an indicator mark on the pool table cushion.

5. The rebound point location as defined in claim 3, wherein, said spindle is comprised of a stationary spindle post and a spring biased rotatable spindle for rotating about the longitude axis of said stationary spindle post, said other end of said twine being attached to said rotating spindle.

6. The rebound point locator device as defined in claim 2, wherein said portion is comprised of a lower portion extending over a horizontal top portion of the rail and downward along an outer vertical portion of the rail, and an upper portion extending over the lower portion and along an inner portion of the rail, means for connecting said upper portion to said lower portion, said means comprising screws and wing nuts to facilitate adjustment of said portion upon said rail.

7. The rebound point locator device as defined in claim 3, wherein said connector means to said post includes a retracting twine spindle whereby the length of said twine may be increased or decreased as said post is moved relative to said measurement member, said post having a needle whereby said post can be positioned.

8. The rebound point locator device as defined in claim 4, wherein said means for placing an indicator mark is a hole for receiving a marker.

9. The rebound point locator device as defined in claims 3, wherein means for maintaining said twine substantially at said midpoint of said measurement member is a stationary post.

* * * * *